US009138040B2

(12) United States Patent
Desai

(10) Patent No.: US 9,138,040 B2
(45) Date of Patent: Sep. 22, 2015

(54) OSCILLATING SHOWER HEAD MASSAGER

(71) Applicant: Haresh S. Desai, Biloxi, MS (US)

(72) Inventor: Haresh S. Desai, Biloxi, MS (US)

( * ) Notice: Subject to any disclaimer, the term of this patent is extended or adjusted under 35 U.S.C. 154(b) by 463 days.

(21) Appl. No.: 13/663,228

(22) Filed: Oct. 29, 2012

(65) Prior Publication Data

US 2014/0117112 A1 May 1, 2014

(51) Int. Cl.

| | |
|---|---|
| ***B05B 15/00*** | (2006.01) |
| ***B05B 17/00*** | (2006.01) |
| ***A45D 42/10*** | (2006.01) |
| ***B05B 1/16*** | (2006.01) |
| ***B05B 1/18*** | (2006.01) |
| ***B05B 3/04*** | (2006.01) |
| ***A45D 42/16*** | (2006.01) |

(52) U.S. Cl.

CPC ..... *A45D 42/10* (2013.01); *A45D 42/16* (2013.01); *B05B 1/16* (2013.01); *B05B 1/18* (2013.01); *B05B 3/0436* (2013.01)

(58) Field of Classification Search

CPC ..... B45D 42/10; B45D 42/16; B05B 1/16; B05B 1/18; B05B 3/0431; B05B 3/0436; B05B 3/0463

USPC ..... 239/289, 263, 263.3, 242; 4/597, 601, 4/605, 615; 359/509, 512, 519

See application file for complete search history.

(56) References Cited

U.S. PATENT DOCUMENTS

| | | | | |
|---|---|---|---|---|
| 4,944,457 | A * | 7/1990 | Brewer | 239/242 |
| 5,032,015 | A * | 7/1991 | Christianson | 359/512 |
| 6,238,052 | B1 * | 5/2001 | Zadro | 359/507 |

* cited by examiner

*Primary Examiner* — Dinh Q Nguyen

(74) *Attorney, Agent, or Firm* — Jeremy M Clay

(57) ABSTRACT

An oscillating shower massager that provides a rotating or oscillating spray pattern that may be adjusted by the user. The oscillating shower massager has a housing with a forward facing water discharge outlet and a rotating side discharge outlet. A water driven gear system drives the rotating side discharge outlet. A series of stop pins are provided that may be used to adjust the rotation. When the stop pins are retracted, the rotating discharge outlet turns a full 360 degrees, allowing the user to spray all the walls and ceiling of the shower stall to facilitate cleaning. When the stop pins are extended, the rotating side outlet provides an oscillating spray pattern. A heated shaving mirror is incorporated onto the front of the housing.

8 Claims, 5 Drawing Sheets

OSCILLATING SHOWER HEAD MASSAGER

FIELD OF THE DISCLOSURE

Showerheads.

PRIORITY

This application does not claim the priority date of any other applications.

BACKGROUND OF THE INVENTION

Showerheads are commercially available in numerous designs and configurations. The types of showerheads may be broadly categorized as being either stationary or oscillating and having either fixed or adjustable water jets. A typical stationary showerhead is composed of a water chamber and a number of fixed jets that deliver water in a constant spray pattern. The spray pattern is limited by the number and direction of the fixed jets. The showerhead typically incorporates a standard ball joint that is connected to the water outlet pipe via a threaded connection. The ball joint gives the user the ability to adjust the position of the showerhead, but the range of adjustability is limited. Thus, the drawbacks of a typical stationary showerhead include a limited range of motion and a limited spray pattern.

Other showerheads may incorporate an oscillating mechanism that produces a variable water spray pattern. While these dedicated oscillating showerheads may provide a pulsating or massage action, they also suffer from a limited range of motion and limited spray pattern.

Conventional fixed and oscillating showerheads make it difficult to clean the shower stall, because a user cannot manipulate the spray pattern to rinse the entire shower. Accordingly, there remains a need for an shower head configuration that provides greater adjustability and a greater spray pattern.

SUMMARY OF THE INVENTION

The oscillating shower massager overcomes the limitations associated with the prior art by providing a rotating or oscillating spray pattern that may be adjusted by the user. The oscillating shower massager has a housing with two water discharge outlets. The oscillating shower massager incorporates a water driven gear system that turns the rotating side discharge outlet. A series of stop pins are provided that may be used to adjust the rotation. When the stop pins are retracted, the rotating discharge outlet turns a full 360 degrees, allowing the user to spray all the walls and ceiling of the shower stall to facilitate cleaning. When the stop pins are extended, the rotating side outlet provides an oscillating spray pattern.

The oscillating shower massager also incorporates a forward facing outlet and heated shaving mirror with an integrated water tank. Water flowing through the integrated water tank raises the temperature of the shaving mirror and eliminates fogging of the mirror. A light source may be incorporated into the heated mirror to provide light for shaving.

DETAILED DESCRIPTION

Figure 1:
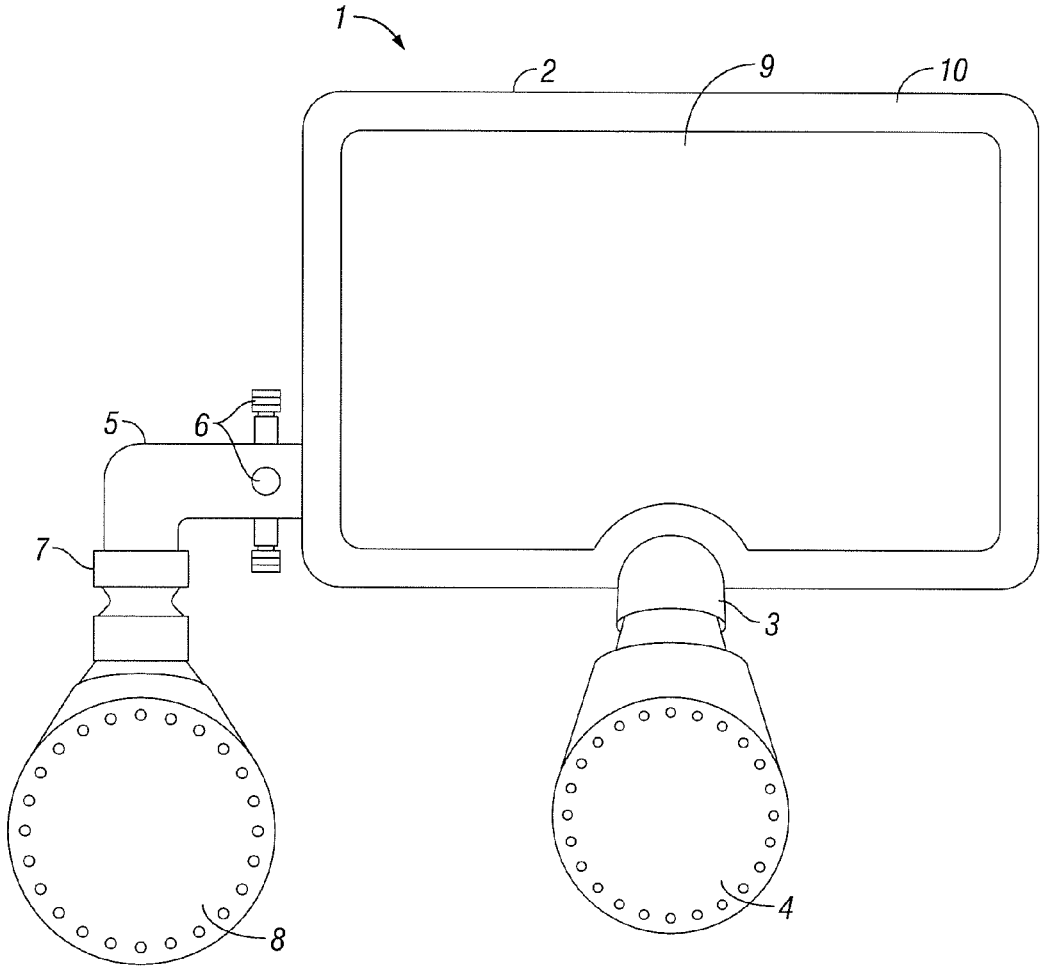
FIG. 1 is a front view of the oscillating shower head massager.

The oscillating shower head massager gives a user the ability to adjust the movement of an oscillating shower head to direct the flow of water in almost any direction. Unlike conventional shower heads that have a limited range of motion, the oscillating shower head massager rotates up to a full 360 degrees. FIG. 1 is a front view of the oscillating shower head massager 1. The massager 1 has a housing 2 with two water outlets. The housing is rectangular in this embodiment, but other housing shapes may be used. The forward facing outlet 3 may be threaded to facilitate connection with other plumbing fixtures. A shower head 4 is connected to the forward facing outlet 3 in FIG. 1.

The rotating side outlet 5 provides rotating or oscillating water flow. A plurality of stop pins 6 are attached to the rotating side outlet 5. The stop pins 6 may be manually extended or retracted. The rotating side outlet 5 may be threaded to facilitate connection with other plumbing fixtures. In this embodiment, a ball joint 7 is connected to the rotating side outlet 5, and a shower head 8 is connected to the ball joint 7. The oscillating shower head massager 1 also incorporates a heated shaving mirror 9. A light source may be included in the rim 10 around the shaving mirror 9 to provide illumination. The light source may include battery powered led lights.

Figure 2:
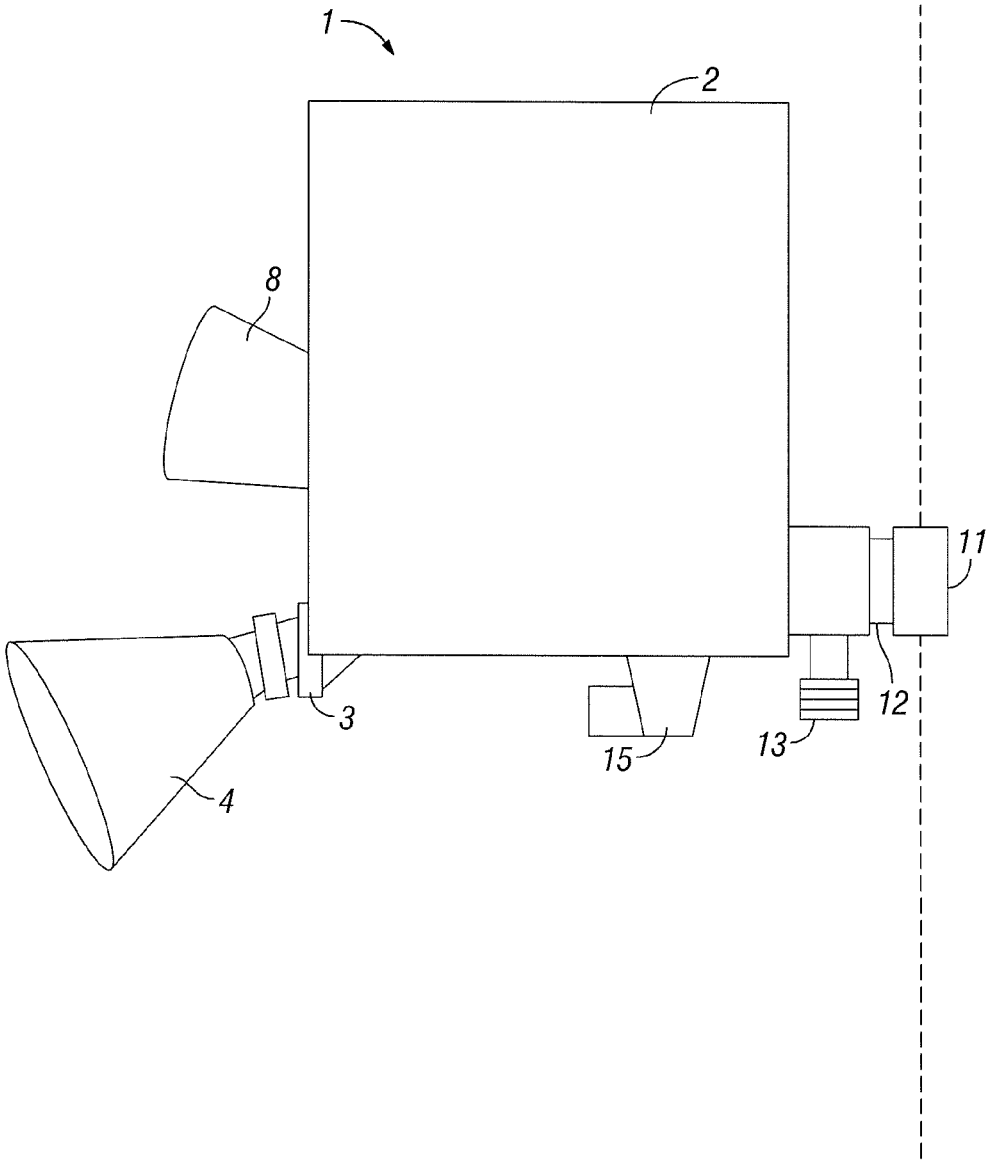
FIG. 2 is a side view of the oscillating shower head massager.

FIG. 2 is a side view of the oscillating shower head massager 1. A fluid inlet 11 is located at the rear of the housing 2. The fluid inlet 11 may include a pipe that is threaded to facilitate connection with other plumbing fixtures, and the fluid inlet may be attached directly to the end of a conventional shower water supply pipe. In this embodiment, the fluid inlet 11 is a moveable ball joint 12. The moveable ball joint 12 includes a set screw 13 that is adapted to lock the oscillating shower head massager 1 in position when the set screw 13 is tightened.

Figure 3:
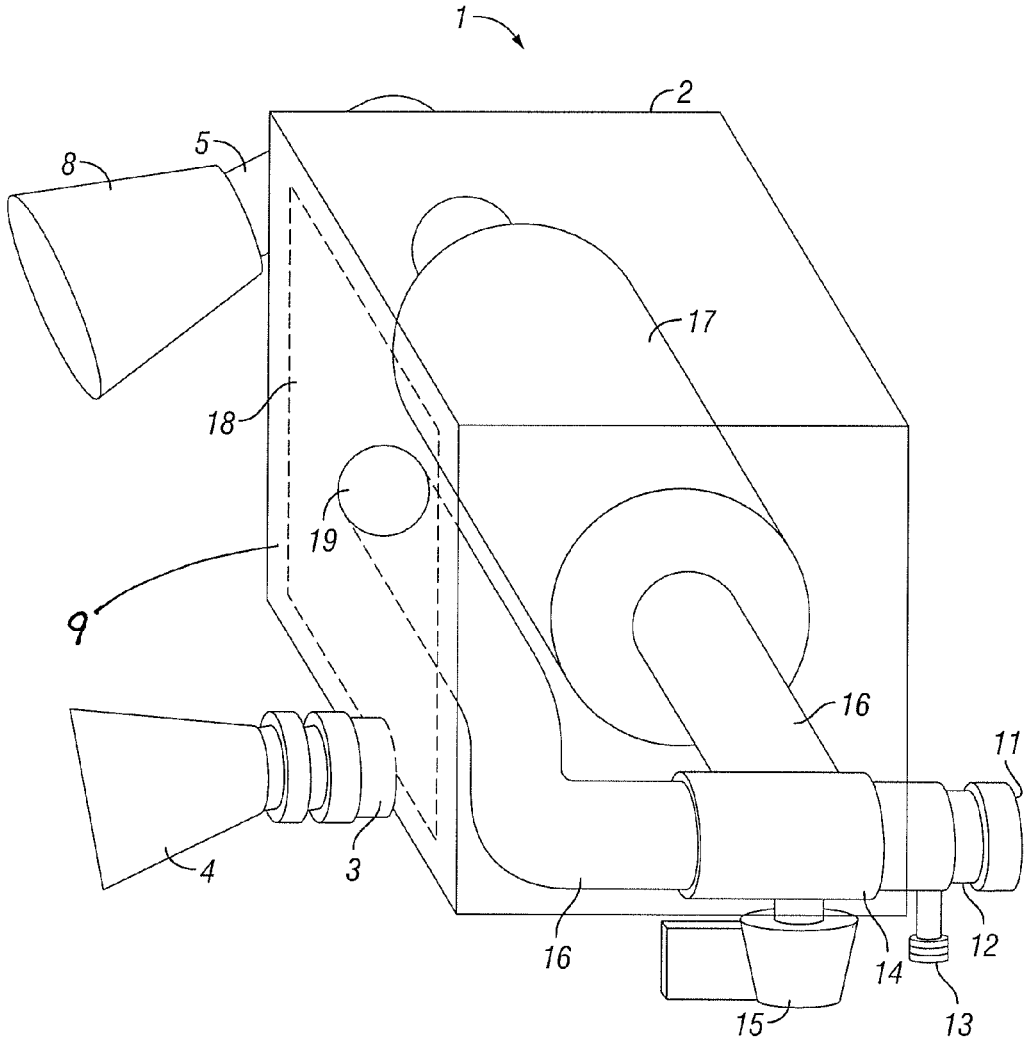
FIG. 3 is a perspective view of the interior of the shower head massager.

FIG. 3 is a perspective view of the interior of the oscillating shower head massager 1. Water enters the rear of the oscillating shower head massager 1 through the inlet 11. The water then enters a 2-way valve 14. The valve 14 is operated by a lever 15 that extends through the bottom of the housing 2. Depending upon the position of the valve 14, water is directed through tubing 16 leading to either the heated shaving mirror 9 or to the water driven gear system 17 that manipulates the rotating side outlet 5.

An integral water tank 18 is attached to the rear of heated shaving mirror 9. To use the mirror 9, the user turns the lever 15 to direct water to the water tank 18. Water flows through the valve 14, through tubing 16, and into an inlet 19 at the top of the water tank 18. The forward facing outlet 3 is connected to the bottom of the integral water tank 18. The water flows through the water tank 18 down to the forward facing outlet 3, and out through the shower head 4 attached to the forward facing outlet 3. The passage of water through the integral water tank 18 raises the temperature of the shaving mirror 9, thereby preventing the shaving mirror 9 from fogging.

When the lever 15 is turned to its other position, water is directed through the two-way valve 14 to tubing 16 attached to the water driven gear system 17. Water passing through the gear system 17 drives the gear system and causes the rotating side outlet 5 to rotate or oscillate. The water driven gear system 17 is similar to systems used in oscillating lawn sprinklers, and variations of the gear system are possible. One embodiment of the gear system is depicted in FIG. 4 for illustration purposes, however, the oscillating shower head massager 1 may incorporate any suitable water driven gear mechanism.

Figure 4:
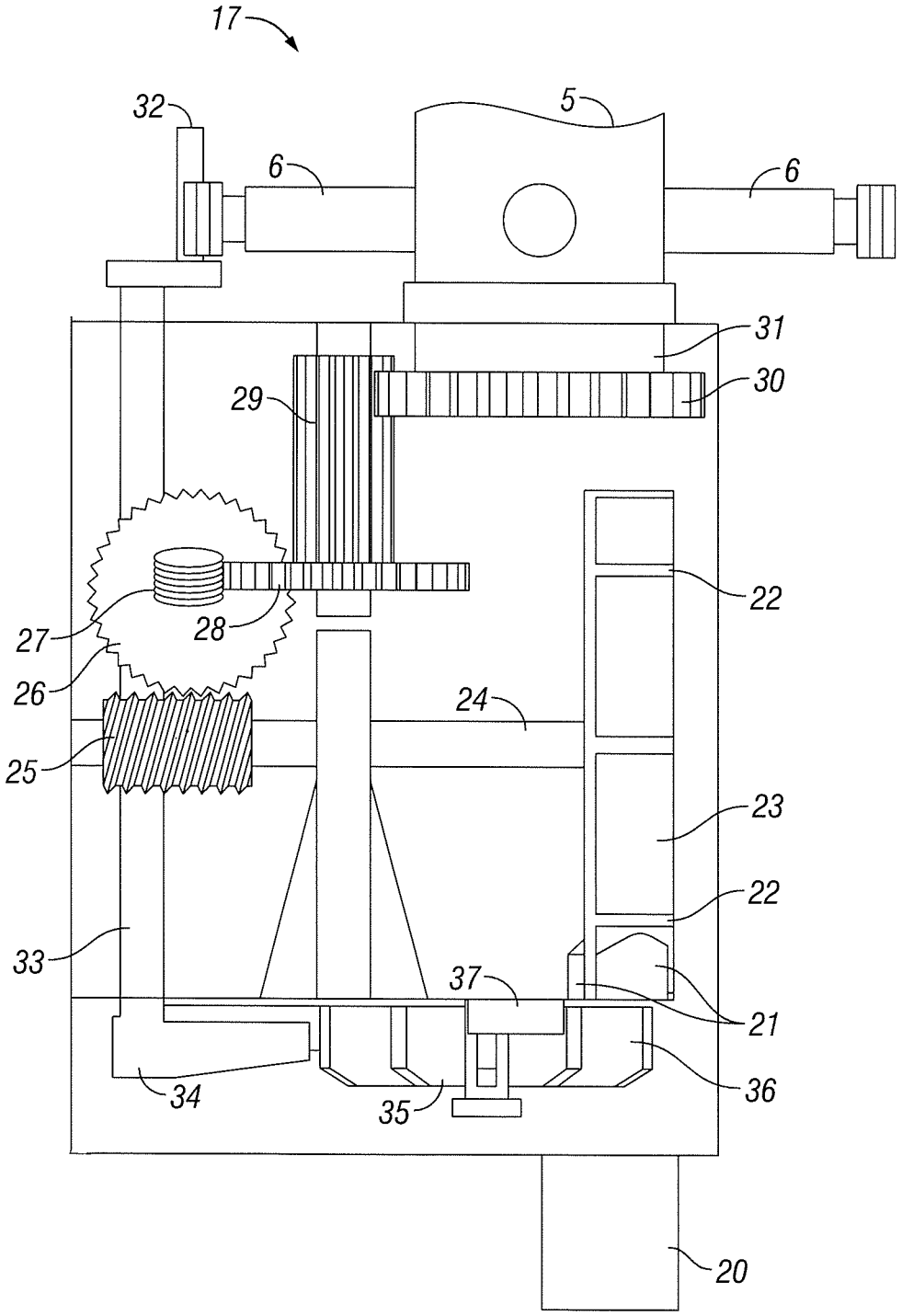
FIG. 4 is a cut-away side view of the water driven gear system.

In the embodiment depicted in FIG. 4, water enters the gear system inlet 20 and then flows through one of two nozzles 21. Water flowing through a nozzle 21 strikes the vanes 22 of a turbine 23, causing the turbine 23 to rotate. The turbine 23 is attached to a shaft 24. The shaft 24 transmits the rotation of the turbine 23 to a first worm gear 25 attached to the upper end of the shaft 24. The first worm gear 25 engages a spur gear 26 which is attached to a second worm gear 27. Rotation of the first worm gear 25 is transmitted through the spur gear 26 to the second worm gear 27. The second worm gear 27 engages a large drive gear 28. The large drive gear 28 is connected to a small drive gear 29, so that rotation of the second worm gear 27 is transmitted through the large drive gear 28 to the small drive gear 29. The small drive gear 29 meshes with the teeth of an annular gear 30 that is attached to the exterior of an inlet 31 for the rotating side outlet 5. Water that enters the gear system 17 forces the turbine 23 to rotate, and that rotation is transmitted through the gear system 17 to turn the rotating side outlet 5. Water that passes through the gear system then enters the inlet 31 for the rotating side outlet 5 and is discharged through the rotating side outlet 5.

The direction of the rotating side outlet's 5 rotation depends on which of the nozzles 21 is transmitting water to the turbine 23. Discharge from one nozzle 21 spins the turbine 23 clockwise, while discharge from the other nozzle 21 reverses the direction of the turbine 23 and reverses the rotation of the rotating side outlet 5. A user controls the direction by manipulating the stop pins 6. A wheel stop lever 32 extends through the side of the housing 2. As the rotating side outlet 5 turns, a stop pin 6 that is extended will strike the wheel stop lever 32 and actuate the lever 32. The wheel stop lever 32 is connected to a shaft 33 that passes through the water driven gear system 17 and is connected to a wheel stop pawl 34.

Figure 5:
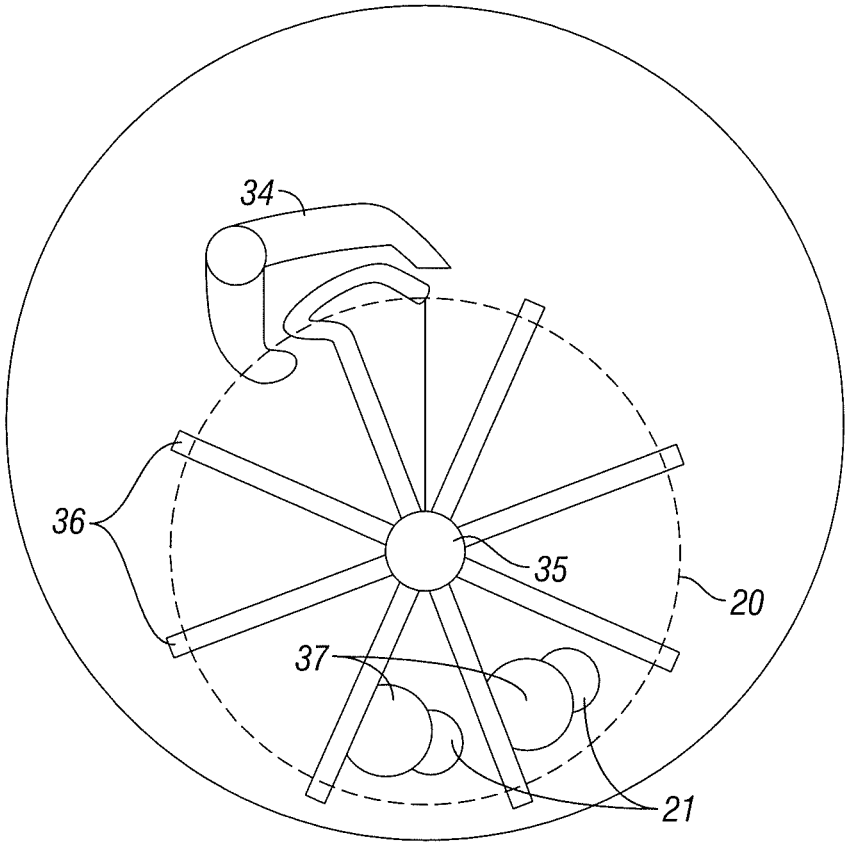
FIG. 5 is a cut-away side view of the water driven gear system.

The wheel stop pawl 34 is depicted in FIG. 5, which shows the inlet end of the water driven gear system 17. The wheel stop pawl 34 has two arms that engage the inlet closing wheel 35. The inlet closing wheel 35 has a series of arms 36, and two of the arms 36 have protrusions 37 that are adapted to cover the water inlet nozzles 21 and stop the flow of water through the nozzles 21. The arms 36 and protrusions 37 are spaced in a manner which allows only one nozzle 21 to be covered at a time.

The stop pins 6 rotate as the rotating side outlet 5 turns. If a stop pin 6 is extended, it will actuate the wheel stop lever 32 as the rotating side outlet 5 turns. Actuating the wheel stop lever 32 rotates the shaft 33 and actuates the wheel stop pawl 34. When the wheel stop pawl 34 is actuated, the arms of the pawl 34 contact the inlet closing wheel 35 and cause the wheel 35 to rotate. When the inlet closing wheel 35 rotates, it moves the protrusions 37 and diverts the water flow from one nozzle 21 to the other nozzle 21, thereby reversing the rotation of the gear system 17 and reversing the rotation of the rotating side outlet 5. When no stop pins 6 are extended, the rotating side outlet 5 turns a full 360 degrees. This allows a user to spray all the walls and ceiling of the shower stall and makes cleaning the shower much easier. When two of the stop pins 6 are extended, the rotating side outlet 5 will oscillate rather than turning a full 360 degrees. This allows a user to select and adjust the range of oscillation.

The foregoing description of preferred embodiments for the oscillating shower head massager is presented for the purposes of illustration and description. They are not intended to be exhaustive or to limit the invention to the precise form disclosed. Obvious modifications or variations are possible in light of the above teachings. The embodiments are chosen and described in an effort to provide the best illustration of the principles of the invention and its practical applications, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An oscillating shower head massager comprising:

a housing having a fluid inlet;

a shaving mirror that is heated by an integral water tank;

one forward facing outlet connected to the integral water tank;

a rotating side outlet;

a water driven gear system adapted to completely or partially turn the rotating side outlet;

a plurality of stop pins attached to the rotating side outlet, where the stop pins may be extended to adjust the rotation of the rotating side outlet;

a wheel stop lever that engages the extended stop pins, the wheel stop lever being connected to the gear system so that actuating the wheel stop lever reverses the rotation of the rotating side outlet, and the rotating side outlet completely rotates when no stop pins are extended but the rotation is reversed when an extended stop pin makes contact with the wheel stop lever; and a valve that alternatively distributes water flow through the integral water tank and forward facing outlet or through the water driven gear system and rotating side outlet.

2. The oscillating shower head massager of claim 1, further comprising a moveable ball joint incorporated onto the inlet, where the moveable ball joint includes a set screw that is adapted to restrict rotation of the shower head massager when the set screw is tightened.

3. The oscillating shower head massager of claim 1, further comprising a shower head attached to the forward facing outlet.

4. The oscillating shower head massager of claim 1, further comprising a shower head attached to the rotating side outlet.

5. The oscillating shower head massager of claim 1, further comprising a light source to illuminate the shaving mirror.

6. The oscillating shower head massager of claim 1, further comprising a threaded fitting on the inlet to facilitate connection of the oscillating shower head massager to other plumbing fixtures.

7. The oscillating shower head massager of claim 1, further comprising a threaded fitting on the forward facing outlet to facilitate connection of the oscillating shower head massager to other plumbing fixtures.

8. The oscillating shower head massager of claim 1, further comprising a threaded fitting on the rotating side outlet to facilitate connection of the oscillating shower head massager to other plumbing fixtures.

* * * * *